United States Patent [19]

Järvinen et al.

[11] Patent Number: 4,540,290

[45] Date of Patent: Sep. 10, 1985

[54] IMMERSIBLE AERATOR AND/OR MIXER APPARATUS

[75] Inventors: Erkki J. Järvinen; Pekka M. Taskinen; Jarmo J. Pullo, all of Outokumpu; Seppo T. Kinnunen, Espoo; Arvo E. Andersson, Outokumpu, all of Finland

[73] Assignee: Outokumpu Oy, Helsinki, Finland

[21] Appl. No.: 576,040

[22] Filed: Feb. 1, 1984

[30] Foreign Application Priority Data

Feb. 2, 1983 [FI] Finland ..... 830354

[51] Int. Cl.[3] ..... B01F 7/16

[52] U.S. Cl. ..... 366/286; 261/87; 261/91; 261/93; 366/279; 366/343

[58] Field of Search ..... 366/101, 102, 261, 281–284, 366/331, 601; 261/87, 93, 91, 29, 36 R, 123; 209/169, 170; 210/219, 220; 416/185, 188

[56] References Cited

U.S. PATENT DOCUMENTS 3,462,132 8/1969 Kaelin ..... 261/87

4,078,026 3/1978 Fallenius ..... 261/87

*Primary Examiner*—Timothy F. Simone

*Attorney, Agent, or Firm*—John Smith-Hill

[57] ABSTRACT

The invention relates to an immersible aerator and/or mixer apparatus to be lowered onto the bottom of a basin or tank containing liquid, often also solid substances, and particularly the invention relates to the supporting structures of the said apparatus as well as to the devices for protecting the motor and power transmission chambers of the said aerator and/or mixer apparatus from the liquid contained in the said vessel.

9 Claims, 1 Drawing Figure

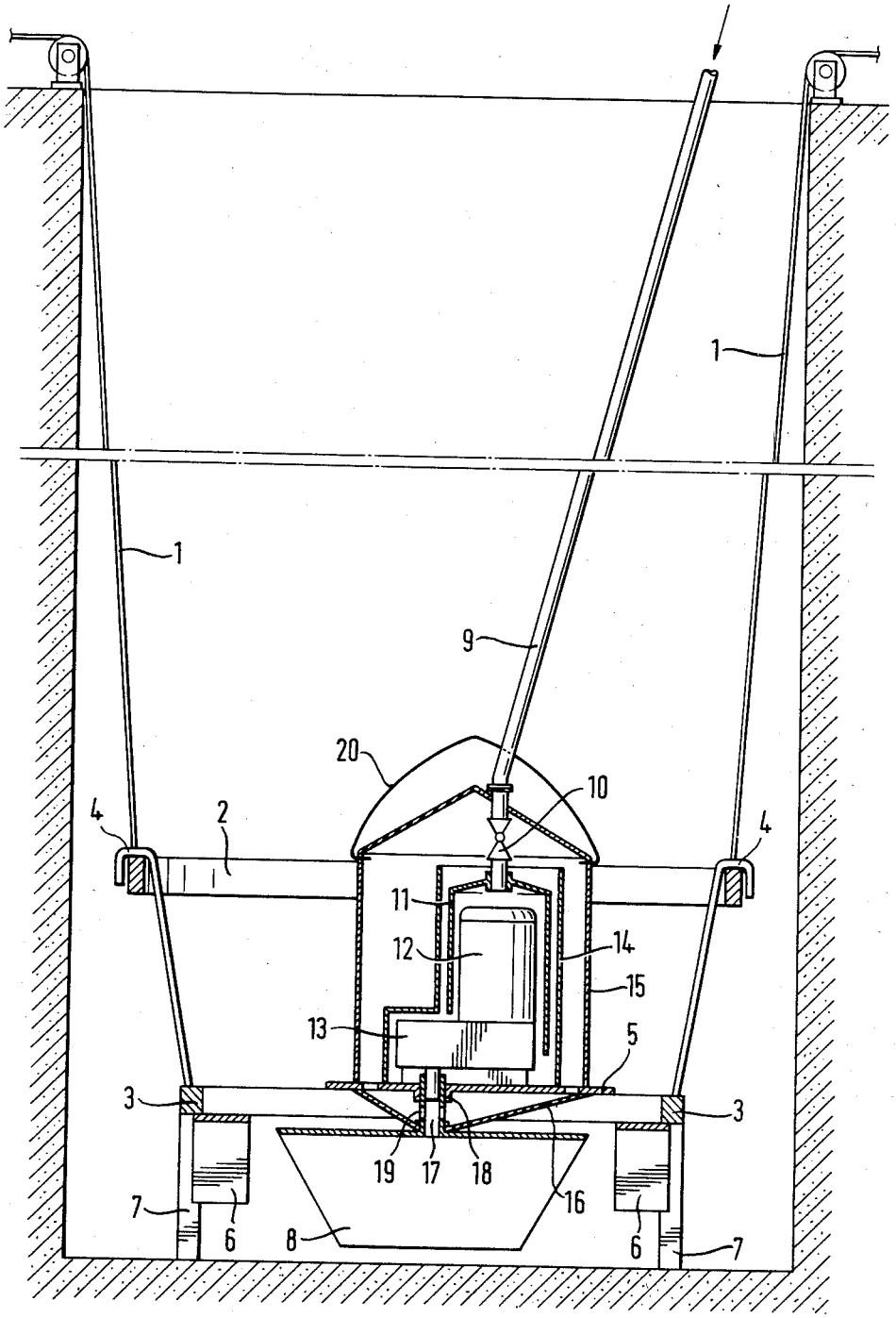
1
1
9
20
10
4
2
4
11
12
14
15
13
5
3
3
19
17
18
16
7
6
8
6
7

IMMERSIBLE AERATOR AND/OR MIXER APPARATUS

The present invention relates to an aerator and/or mixer apparatus which is immersed onto the bottom of a basin or tank containing liquid, often also solid substances, and particularly the invention relates to the supporting structures of the said apparatus as well as to the devices for protecting the motor and power transmission chambers of the said apparatus from the liquid contained in the said vessel.

Most prior art mixer apparatuses are operated so that they are suspended from an upper shaft. When the depth of the basin or tank substantially exceeds 10 m, these suspended aerator and/or mixer apparatuses cannot be used. Usually only such apparatuses that can be lowered onto the bottom of the basin can be employed in these cases. The problem with these apparatuses is how to protect the motor from the surrounding liquid and how to give the apparatus a sufficiently effective support. The mixer apparatus can also be fixed onto the bottom of the basin in a stationary fashion, in which case the basin has to be emptied during maintenance.

The purpose of the present invention is to isolate the operation unit of the immersed aerator and/or mixer apparatus (=its motor and other devices belonging to the operation machinery) from the surrounding liquid by means of three nested protective casings and by means of a gas flow conducted into the innermost casing. Another purpose of the invention is to provide the apparatus with an adequate support by means of a supporting ring that surrounds the operation unit and the mixing unit therebelow. The essential characteristics of the present invention are apparent from the patent claim 1.

The aerator and/or mixer apparatus comprises three main units: the aerator and/or mixer unit proper, the operation unit, and the supporting structure. The protective arrangement of the operation unit and the supporting structure according to the present invention can be applied to most generally known aerator and/or mixer apparatuses, but in our application the said functions are described as combined to the rotor-stator member of the mixer according to U.S. Pat. No. 4,078,026. The shaft of the apparatus of the said patent is replaced by legs which are fixed to the frame beams, and by a supporting ring which gives support to the mixing and operation units. The supporting ring makes the structure so steady that the torque caused by the rotation of the rotor does not cause the whole apparatus to rotate, even if the mixer apparatus were remarkably large.

In the following the invention is described in more detail with reference to the appended drawing which is an illustration of one preferred embodiment of the invention seen in cross-section.

The apparatus, provided with support lugs 4, which lugs are fastened to the frame beams 3, is lowered onto the bottom of the basin so that the whole apparatus rests on the supporting ring 2, which again is supported by three wire cables 1. The said apparatus comprises the operation unit located above the frame plate 5 which is attached to the frame beams 3, and the mixing unit located below the frame plate 5. The mixing unit comprises the stator 6, the legs 7 fixed to the frame beams 3, which legs reach down to the bottom of the basin, and the rotating rotor 8. Gas is conducted into the basin through the rotor in order to aerate the basin or in order to mix the liquid therein, the said gas being for instance air or oxygen.

The gas is conducted through the pipe 9 leading to the upper part of the operation unit and through the valve 10 installed in the pipe. Inside the operation unit, the gas flows within the air guide casing 11 and simultaneously cools the motor 12 and the power transmission equipment 13. The bottom of the air guide casing 11 is not attached to the frame plate 5, wherefore the gas may circulate through this bottom passage into the space limited by the inner casing 14, which surrounds the air guide casing 11. The bottom of the inner casing 14 is tightly fixed to the frame plate 5, but the top of the inner casing 14 is not fixed to the outer casing 15, wherefore the gas may freely flow through the space limited by the outer casing 15 and the inner casing 14 into the bottom cone 16. Within the bottom cone 16 there is located the drive shaft 17 of the power transmission equipment of the operation unit; around this drive shaft 17 there is fitted a collar-like axis 18, which connects the drive shaft 17 to the rotor 8. On the bottom cone side of the collar-like axis 18 there are apertures 19, through which the gas flows onto the rotor 8. The gas is conducted into the operation unit through a pipe leading from a pressurized gas container located outside the basin. The bottom of the outer casing 15 is attached to the frame plate, and thus the outer casing forms a uniform outer cover for the whole operation unit.

When the mixer and/or aerator unit is being lowered onto the bottom of a basin or a tank, or when the gas infeed is interrupted for other reasons, the valve 10 is immediately closed in order to prevent the gas contained in the operation unit from escaping through the gas pipe. Now the liquid contained in the basin starts to rise into the operation unit, but the size of the space limited by the outer and inner casings is designed so that, even when operation depth is for example 50 m, the liquid or sludge contained in the basin can neither rise above the top edge of the inner casing nor flow into the motor chamber therefrom. Thus the casings together form a gas trap. When gas feeding is started, the valve 10 is opened and the gas pressure pushes away the sludge gathered within the outer casing.

The mixer apparatus is lowered into the basin by means of wire cables. At the same time, the wire cables support the supporting ring 2 so that it can receive and eliminate the torque caused by the rotation of the rotor, both if the apparatus is located on the bottom of the basin and if it is located above the bottom. The support lugs 4 are locked into place onto the supporting ring by using some suitable means, for example hooks. This prevents the mixing unit from moving in a different direction with respect to the supporting ring. The operation unit can also be provided with a lifting handle 20 in order to direct the apparatus onto the bottom of the basin.

The following additional advantages of the present invention can be enlisted: a separate suspended operation shaft is replaced by the operation unit located near the mixer unit, and therefore the apparatus can be used even in remarkably deep basins, for instance when aerating at the bottom of a lake or equivalent. The apparatus can also be employed in processes requiring high temperatures, because the motor is cooled by the gas conducted into the mixer and not for instance by the liquid contained in the basin. The apparatus has a steady structure owing to the supporting ring and the support lugs fastened thereto.

The devices within the operation unit can be ordinary devices, special materials such as acid-proof steel or special bearings are not necessary. When the apparatus is lowered onto the bottom of a basin where precipitate is formed, operation can already be started during the lowering stage, so that the apparatus sends the precipitate whirling, i.e. "beats it up". It is not necessary to empty the basin during maintenance.

In the above description it has already been mentioned that the rotor-stator mixer unit according to the drawing is only one possible modification. Some other type of mixer can be employed instead of it. When the apparatus is used as an aerator, air can be sucked in for instance from the lake surface, in which case the pressure air equipment is located within the operation unit.

We claim:

1. An immersible apparatus for agitating liquid, comprising an operation unit and an agitator unit, said operation unit having an outer casing, inlet means for supplying gas under pressure to the outer casing, a motor enclosure disposed within the outer casing in spaced relationship with respect thereto, a motor disposed within the motor enclosure and operatively connected to the agitator unit, and outlet duct means for conducting gas from the space between the outer casing and the motor enclosure to leave the apparatus by way of the agitator unit, said inlet means including a non-return valve for preventing gas from leaving the outer casing by way of the inlet means, said valve, said outer casing and said motor enclosure together defining a gas trap which, in the event of interruption in the supply of gas to the outer casing, prevents liquid that enters the operation unit by way of the agitator unit from contacting the motor.

2. An apparatus according to claim 1, comprising support means for the operation unit and the agitator unit, said support means comprising a frame plate to which the operation unit and the agitator unit are secured, the operation unit being disposed above the frame plate and the agitator unit being disposed below the frame plate, a supporting ring, and means connecting the frame plate to the supporting ring so that it is supported thereby.

3. An apparatus according to claim 2, wherein the duct means include an aperture in the frame plate.

4. An apparatus according to claim 2, wherein the frame plate is secured to frame beams and the frame beams are provided with lugs which releasably engage the supporting ring.

5. An apparatus according to claim 2, wherein the lugs include hooks.

6. An apparatus according to claim 1, comprising a frame plate secured to the bottom of the outer casing, and wherein the motor enclosure comprises an inner casing located inside the outer casing and secured at its bottom to the frame plate and defining an interior space within which the motor is disposed, said interior space communicating by way of the top of the inner casing with the space defined between the outer casing and the motor enclosure, whereby upon interruption in the supply of gas to the outer casing, gas trapped within the outer casing restricts entry of liquid into the operation unit by way of the agitator unit.

7. An apparatus according to claim 6, wherein said motor enclosure comprises an air guide casing located inside said inner casing in spaced relationship with respect thereto, wherein the inlet means for supplying gas under pressure to the outer casing comprise a pipe for delivering gas under pressure from an external source to the interior of the air guide casing, and wherein the interior of the air guide casing communicates by way of the bottom of the air guide casing with the space defined between the inner casing and the air guide casing.

8. An apparatus according to claim 7, wherein the air guide casing is generally bell-shaped and fits over the motor, so as to guide the flow of gas from the inlet means past the motor in order to cool the motor.

9. An apparatus according to claim 6, wherein said outlet duct means include an aperture in the frame plate between the bottom of the inner casing and the bottom of the outer casing.

* * * * *